US007371342B2

(12) United States Patent
Cerda et al.

(10) Patent No.: US 7,371,342 B2
(45) Date of Patent: May 13, 2008

(54) METHOD FOR UNLOCKING NOZZLES OF REACTORS

(75) Inventors: Luis Cerda, Santiago (CL); Alex M Moyano, Santiago (CL); Domingo Montoya, Santiago (CL); José Parraguez, Santiago (CL); Ricardo Amigo, Santiago (CL); Justo Luna, Santiago (CL)

(73) Assignees: Corporation Nacional Del Cobre De Chile, Santiago (CL); Instituto De Innovacion En Mineria Y Metalurgia S.A., Santiago (CL)

( * ) Notice: Subject to any disclaimer, the term of this patent is extended or adjusted under 35 U.S.C. 154(b) by 0 days.

(21) Appl. No.: 10/839,703

(22) Filed: May 6, 2004

(65) Prior Publication Data

US 2006/0226254 A1 Oct. 12, 2006

(51) Int. Cl.
*C21C 5/46* (2006.01)

(52) U.S. Cl. ..... 266/136; 239/106; 239/112; 239/407; 239/433; 266/269

(58) Field of Classification Search ..... 239/106–108, 239/110, 112, 407, 409, 413, 426, 433; 222/3, 222/195; 266/47, 135, 136, 269
See application file for complete search history.

(56) References Cited

U.S. PATENT DOCUMENTS 1,694,218 A * 12/1928 Hazard ..... 417/243
2,480,394 A * 8/1949 Cavers et al. ..... 266/136
2,696,979 A * 12/1954 Berge ..... 266/89
3,722,814 A * 3/1973 Miyashita ..... 239/1
4,051,982 A * 10/1977 Stetson ..... 222/195
4,077,747 A * 3/1978 Burenga ..... 417/234
4,346,822 A * 8/1982 Wadensten et al. ..... 222/195
4,449,644 A * 5/1984 Matson ..... 222/3
4,989,839 A * 2/1991 Simms et al. ..... 266/80
5,123,632 A * 6/1992 Schmit et al. ..... 266/47
5,254,144 A * 10/1993 Provol ..... 95/280
5,332,419 A * 7/1994 Lemay et al. ..... 75/533
5,397,108 A * 3/1995 Alexander et al. ..... 266/100
5,462,605 A * 10/1995 Szucs ..... 134/7

* cited by examiner

*Primary Examiner*—Kevin Shaver
*Assistant Examiner*—Jason Boeckmann
(74) *Attorney, Agent, or Firm*—Millen, White, Zelano, Branigan, P.C.

(57) ABSTRACT

Method intended to unblock enriched air blow or reaction gases nozzles in reactors or fusion converters for mining industry pyrometallurgy CHARACTERIZED by the injection of discrete air impacts with time intervals regulated to high pressure and rate through the enriched air blow or reaction gases nozzles; thus, the air impacts penetrate into the melting bath of such reactors or converters, producing the breaking of blocking accretions that dug the flow of such a enriched air or gas through the nozzle and forming, because the cooling provoked by the penetration of them, a directed accretion with material of the melting bath which is solidified by the cooling effect, allowing that the production of directed accretion be a natural lengthening of the tube of nozzle from the inner wall of these reactors or converters, and by this way to allow that the O2-enriched air blowing through the nozzle enters deeper in the melting bath, to a distance where breaking waves of this flow are generated far of the wall that has refractory material of the reactors or converters, preventing the earlier erosion of the refractory material and tending to eliminate the possible obstructive accretions that can be formed.

13 Claims, 8 Drawing Sheets

METHOD FOR UNLOCKING NOZZLES OF REACTORS

Figure 1:
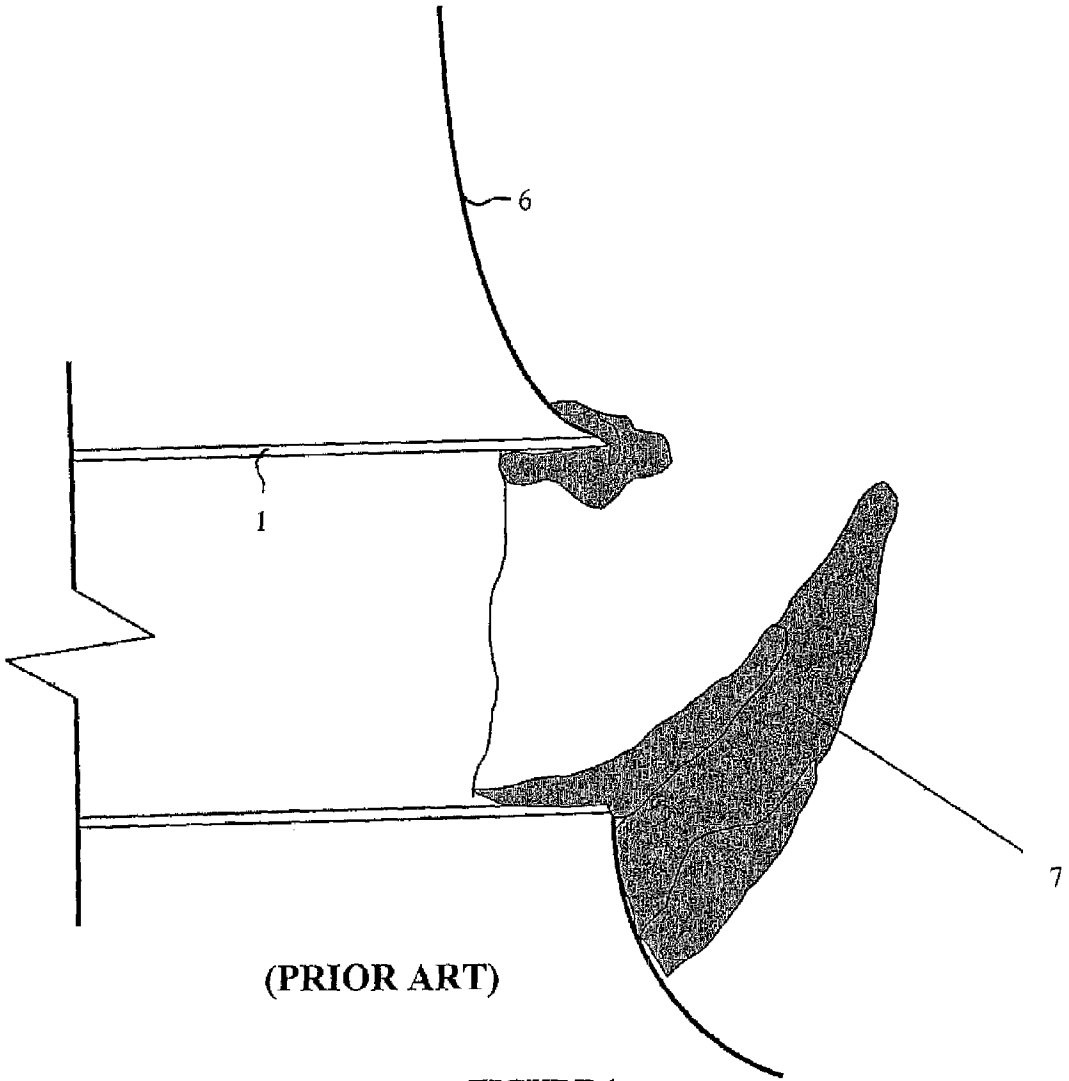
(PRIOR ART) FIGURE 1

The present patent application involves a method and system specially designed to put into practice the procedure intended to unblock the air/gas blow nozzles of reactors or fusion converters in pyromelallurgy in the mining industry. Particularly, the application is directed to a method and system of injection of high pressure and rate air impacts which inhibit the occurrence of blocking accretions in the inner end of air/gas blow nozzle of a converter or fusion reactor in fur metallurgy.

PREVIOUS ART

The occurrence of blocking accretions in O2-enriched air blow nozzles in reactors or fusion converters has a relevant effect on the lifetime period and the performance of pyrometallurgic facilities in the mining industry, specially the reactors or converters used in the copper industry. These air blow nozzles are used for injecting enriched air under the level of the bath to a moderate pressure, between 15 and 20 psi (1,034 and 1,378 bar), generally in a horizontal position, and configured as tubes embedded into the refractory material of the reactor or converter.

The discharge of this relatively cold enriched air into the melting bath, which has a temperature near to 1300° C., produces the phenomenon of localized solidification in form of accretions which, because the shapes adopted (see FIG. 1), block progressively the pass area in the inner end of the nozzle, decreasing the flow of enriched air. All of that demands the necessity of periodic mechanical punching in order to eliminate the obstruction and restore the blowing flow.

At the present time, the most used way to eliminate the blocking accretions is by means of a punching bar operated from a machine especially intended for that; for instance, a GASPE machine. This punching bar is a metalic rod which is inserted through the hole situated in the outer end of the blow nozzle.

The punching has the disadvantage that the effect of such a procedure is based in a total or partial mechanical extraction of the accretion. When the sharp end of the punching bar hits such accretions, the breaking or splitting of the refractory imterial which surrounds the inner end of the nozzle generally occurs. Moreover, the procedure can fracture or even break the tube which is part of the very nozzle. While this occurs, the refractory wall is weakened therefore the lifetime of the reactor or converter is decreased.

The punching bar is introduced visually by an operator who is in a cabin located to a significant distance from each nozzle. From there, the operator must aim each hole of the nozzle with the bar, which involves a long time for introducing and subsequently pulling the bar. By the other side, since the bar contacts the melting bath to temperatures over 1200° C., it produces geometric deformations and degenerations in the constitution of the steel, material from which the bar is composed. Thus, the bar looses its thermophysical characteristics and such a deformation occurs. Therefore, when the operator must insert the bar into the next nozzle, if he does not aim correctly to the hole of that nozzle, a deformation of the sharp end of the hot punching bar is produced. This involves violent detachment of the blocking accretion and dragging with it part of the refractory material adhered.

By the other side, when the bar is retired from the inner part of a nozzle, resistance is generated because part of the material from the melting bath is dragged with it. Then, this material stays in the tubes which comprise the nozzles. This material adhered to the inner part of the nozzle tube produces alterations in its structure, like porosities in which a larger accretion will be adhered, provoking an uncontrolled erosion of the very length of the tube which is part of the nozzle.

Considering the problems with the previous art, the present application solves them in a great proportion through an injection system of air blast (i.e., "impacts") at high pressure and rate, which have the tendency to produce a non-obstructive directed accretion.

The advantages of this invention are related with the following: when a high pressure air impact, between 70 and 100 psi (4.82 and 6.89 bar), is injected, the air enters more deeper in the melting bath improving the fusion conditions and decreasing the "splashing" close to the refractory material, preventing its premature erosion by friction. On the other hand, since the accretions inside of the converter and suffounding the internal end of the nozzle are produced after 1 minute of enriched air blowing through the nozzle, the making of a high pressure and rate air impact injection allows to inhibit the formation of an obstructive accretion. On the contrary, as is possible to see in the FIG. 2 a directed accretion is produced which eliminates automatically one of the causes of the erosion of refractory material.

At the same way, since the fact that a bar or other mechanical element for removing accretions is not used, the dragging of material from melting bath through the tube towards the outside of nozzle and then the tube itself is not prematurely eroded.

When the directed accretion has been formed as a tubular extention, a natural lengthening of the nozzle is obtained of a distance "s" (FIG. 2), due to which the penetration of enriched air into the melting bath will be deeper and, consequently, better use of the reaction air and an improvement of the reaction kinetics is obtained. Therefore, since the enriched air enters at a longer distance from the wall of refractory material, in a zone of the melting bath where surge already exists, the occurrence of obstructive accretions will be eliminated because the very surge tends to remove them, consequently, there is a combination of surge, high pressure and rate of air impact produced by the distance "s".

A BRIEF DESCRIPTION OF THE FIGURES

FIG. 1: corresponds to a cross section diagram about the formation of obstructive accretions in the inner end of the enriched air blow nozzle.

Figure 2:
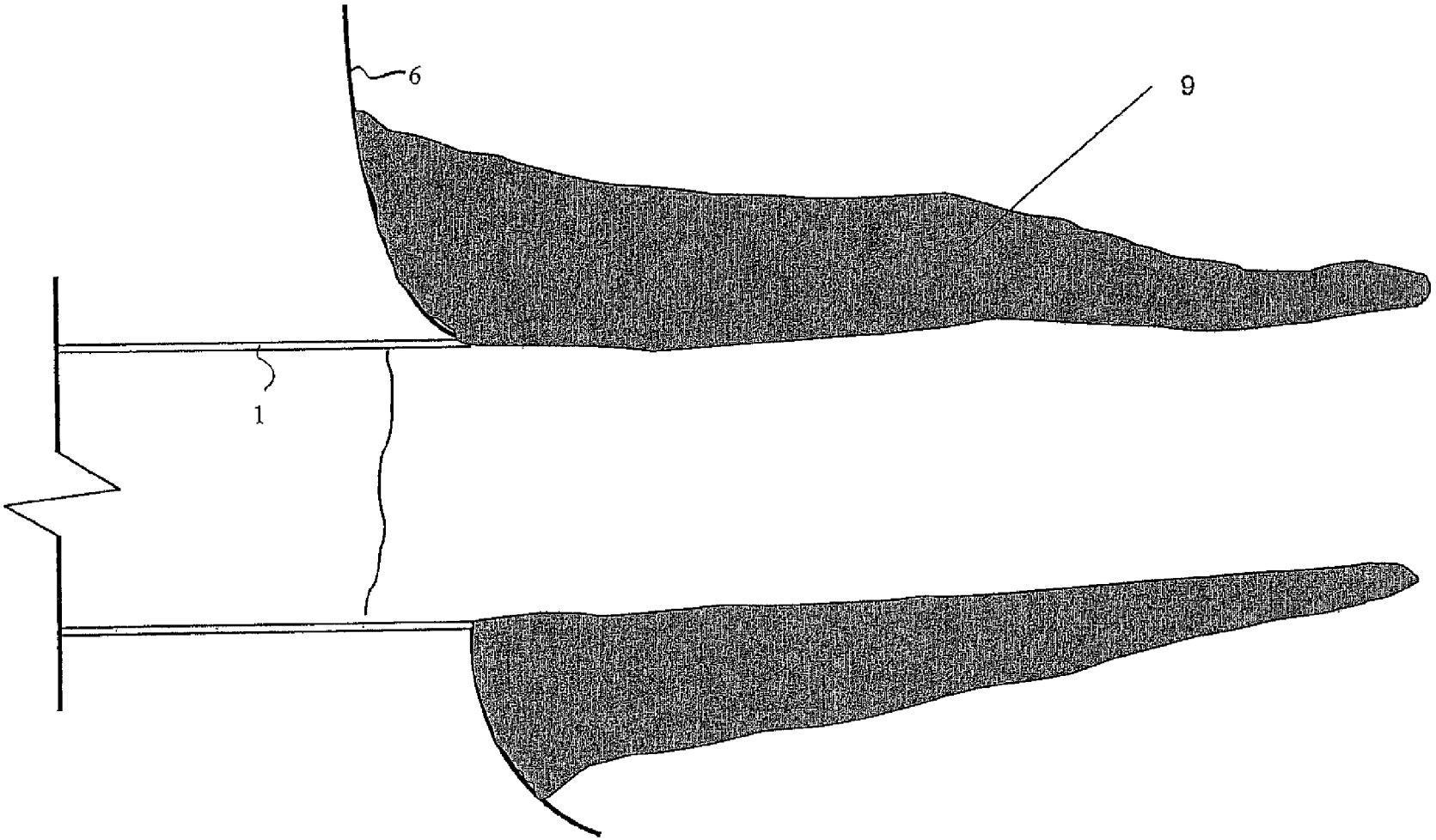

FIG. 2: corresponds to a cross section diagram of the formation of directed accretions in the inner end of the air blow nozzle when air impacts according to of the present invention are applied.

Figure 3:
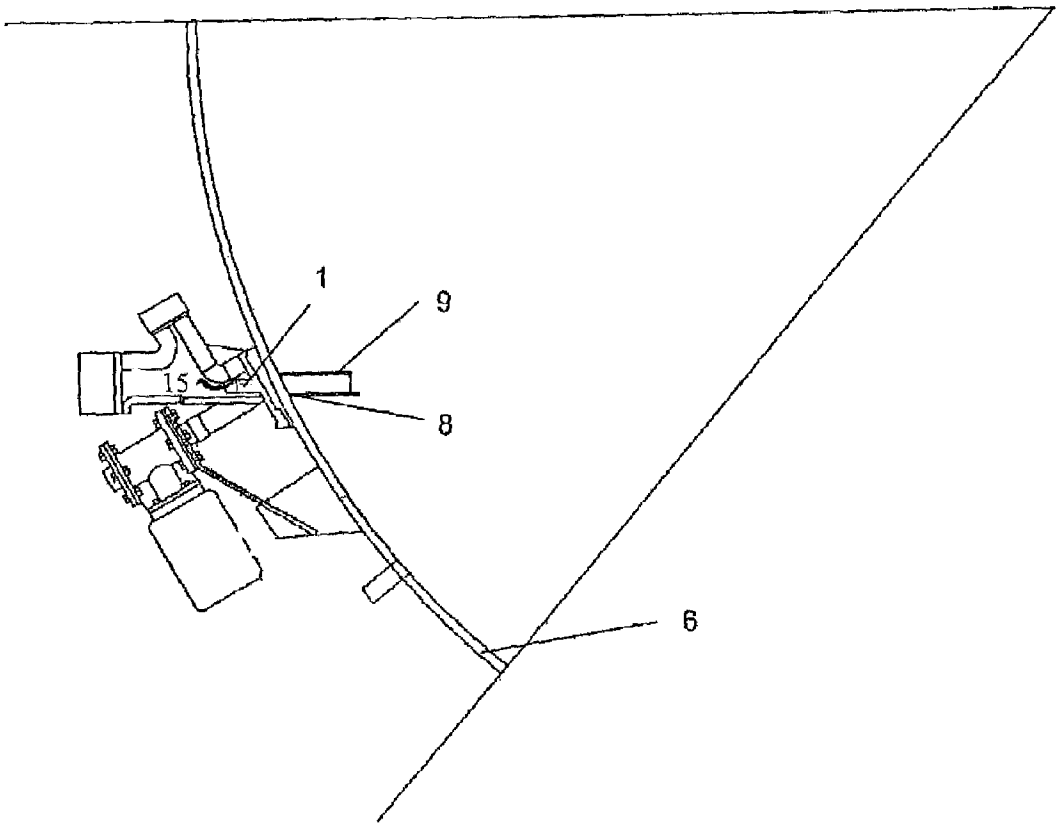

FIG. 3: corresponds to a cross section diagram of the configuration of injection system of air impacts from the present invention, located in the air blow nozzle and, in turn, this nozzle located on the casing of a standard converter or reactor.

Figure 4:
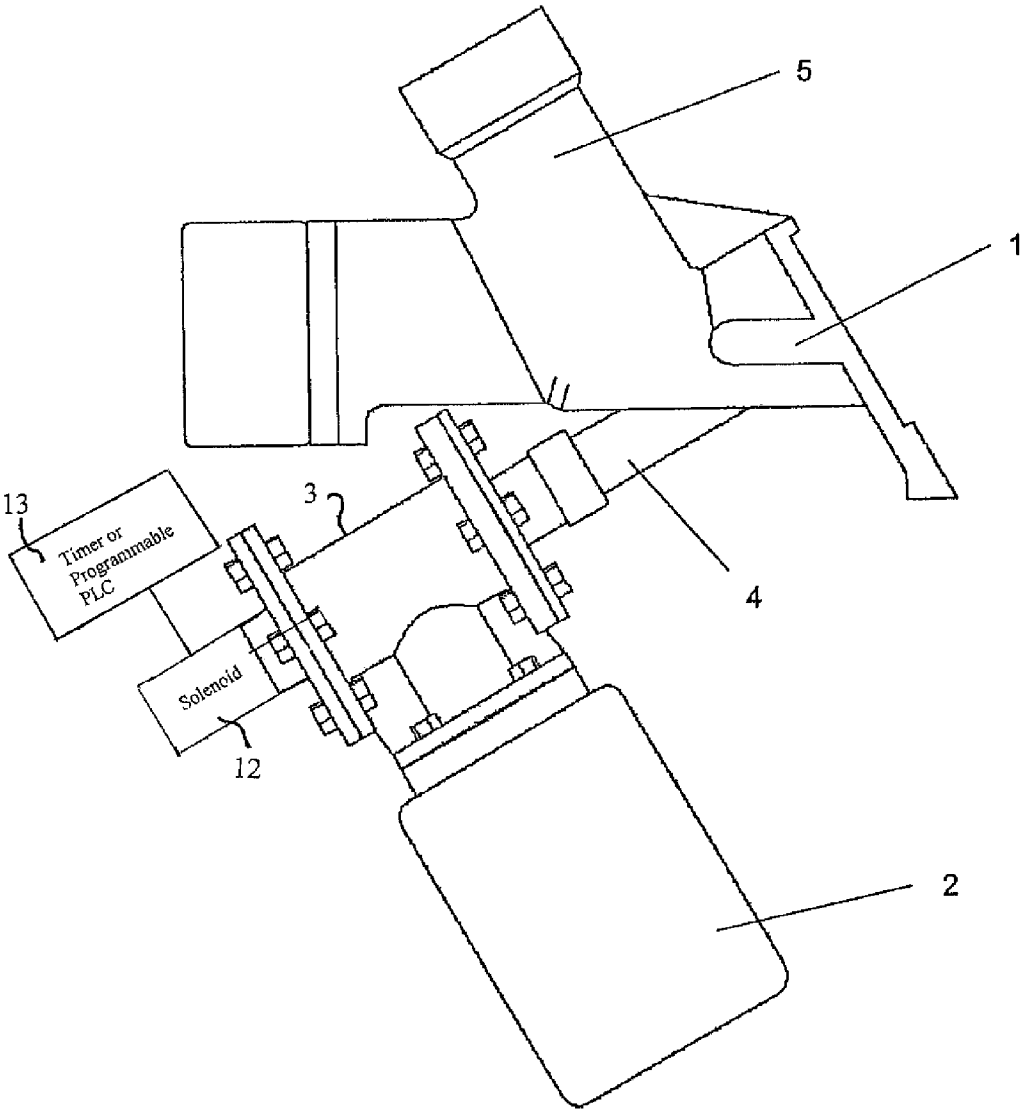

FIG. 4: corresponds to a cross section diagram of the injection system of air impacts from the present invention.

Figure 5:
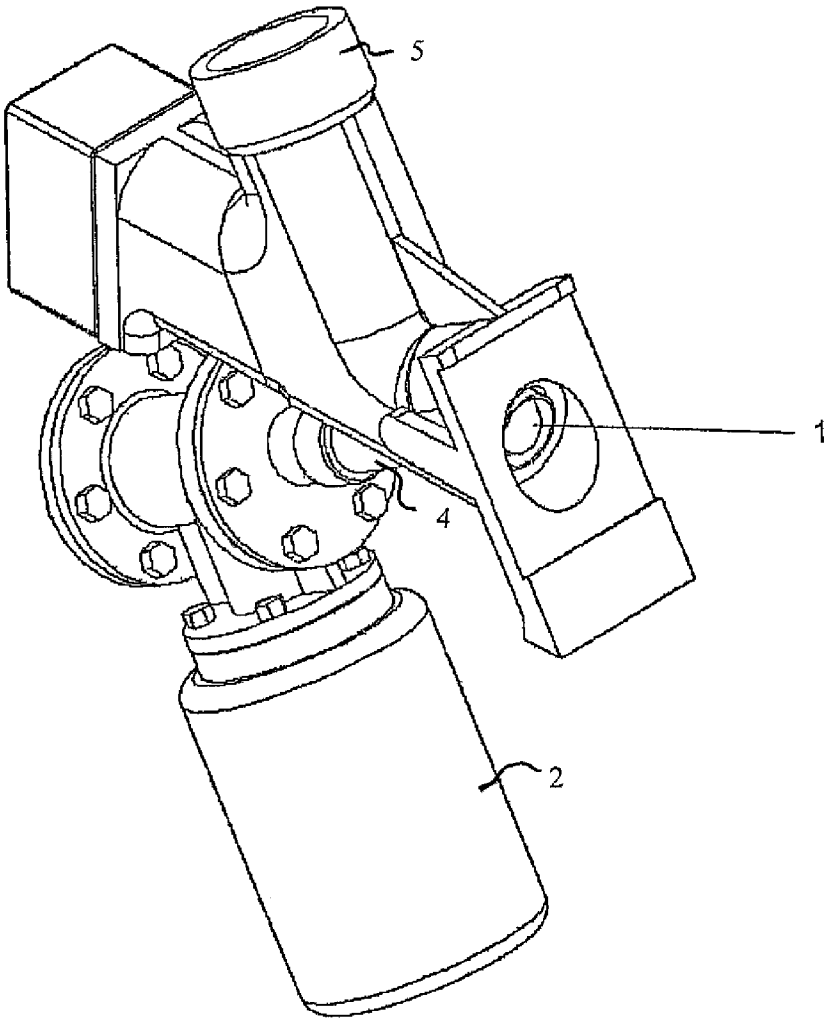

FIG. 5: corresponds to a perspective view, seen from back and from top of the injection system of air impacts from the present invention.

Figure 6:
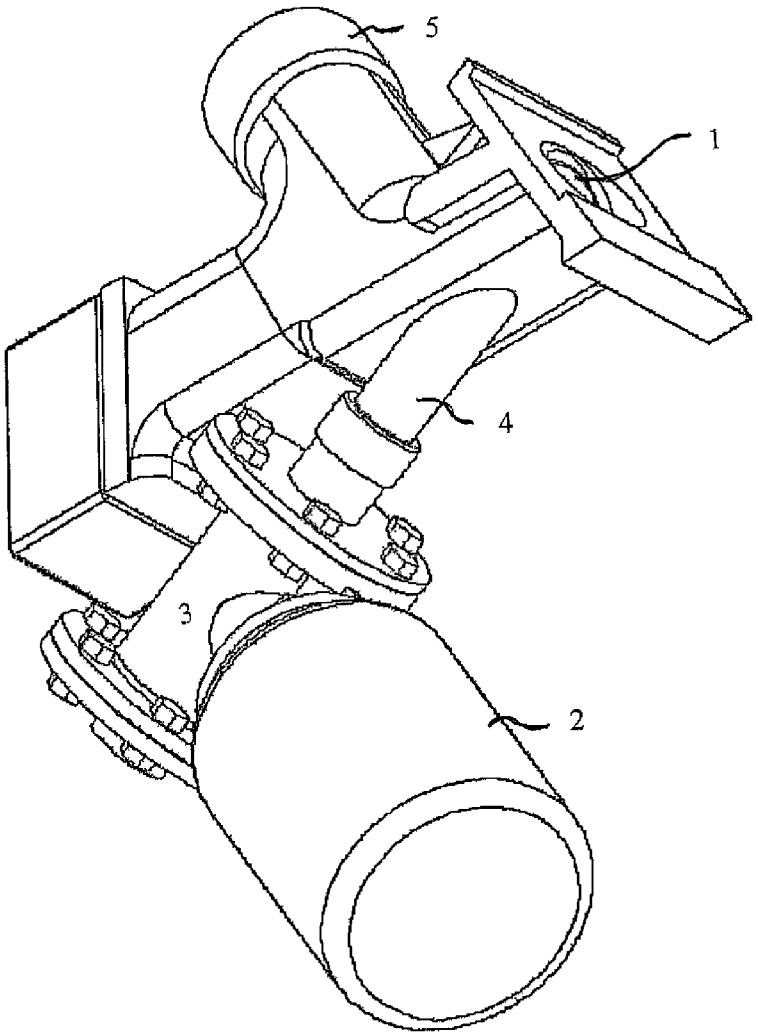

FIG. 6: corresponds to a perspective bottom view of the injection system of air impacts from the present invention.

Figure 7:
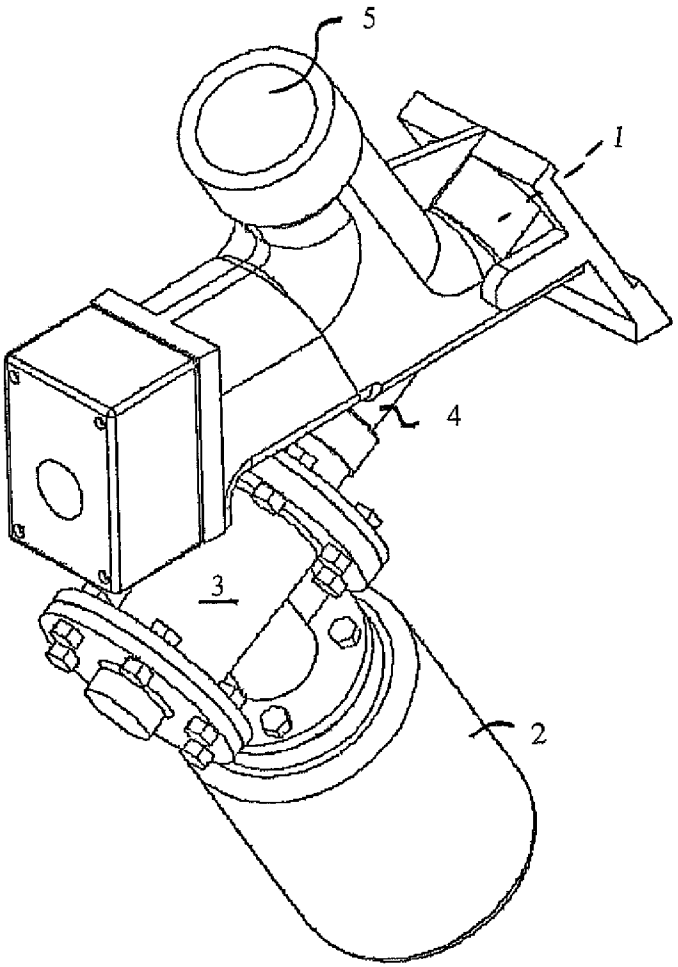

FIG. 7: corresponds to a perspective view, seen from back and from top, but from the other side respect to that shown in the FIG. 5, of the injection system of air impacts from the present invention.

Figure 8:
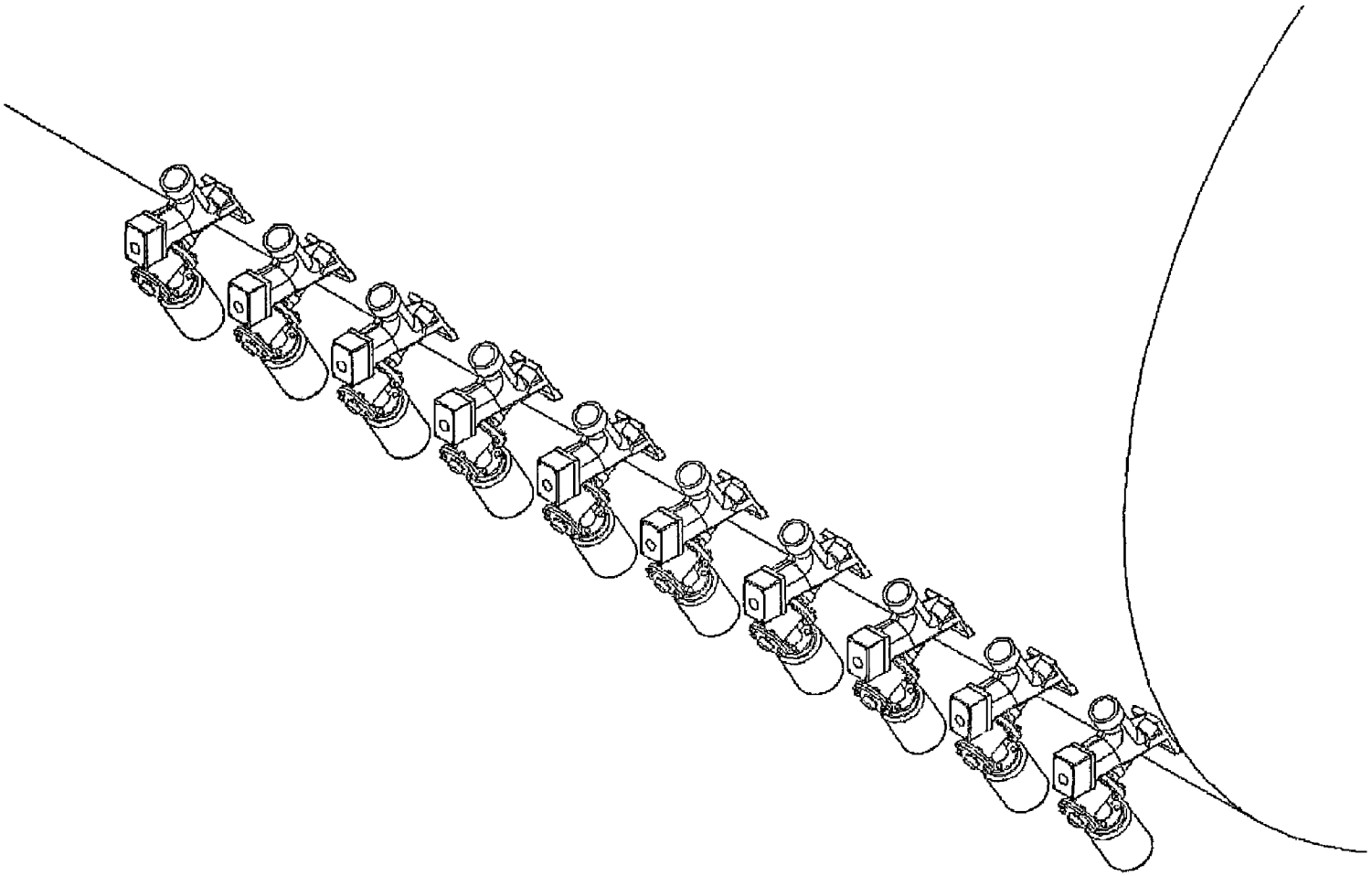

FIG. 8: corresponds to a perspective view of a series of injection systems of air impacts, placed on multiple nozzles in a standard converter or reactor.

DETAILED DESCRIPTION OF THE INVENTION

The invention is a system and method intended to unblock the air or gas blow nozzles of reactors or fusion coverters in the pyrometallurgy and mining industry using the injection of discrete air impacts, regulated to high pressure and rate, through the enriched air blow nozzles in reactors or pyrometallurgical converters.

The method involves the injection of high pressure and rate air impacts through a nozzle (1) using a system formed by an accumulator (2) that stores the compressed air to be injected in the form of impacts through the nozzle (1). The compressed air is stored in the accumulator (2) at a pressure between 70 and 100 psi (4.82 and 6.89 bar). For such an effect, the accumulator (2) has a capacity ranging between 40 and 60 liters of air, which will depend of the pressure desired for the impact. The following table observes the pressure associated with volume in order to achieve this pressure:

| Pressure in bar (psi) | Volume in liters |
|---|---|
| 4.82 (70) | 42 |
| 5.17 (75) | 45 |
| 5.65 (80) | 48 |
| 5.86 (85) | 51 |
| 6.20 (90) | 54 |
| 6.55 (95) | 57 |
| 6.89 (100) | 60 |

Over the accumulator a piston valve (3) added intended to evacuate, in a split second, preferentially 0.09 s, all the air contained in the accumulator (2). The valve (3) in turn is connected from one of its sides to the lower part of the tube which is part of the nozzle (1). This connection is performed through the tube (4) which has a diameter equal or lesser than that of the tube which is part of the nozzle (1). Therefore, when the air contained in the accumulator (2) is released by the activation of the valve (3), the compressed air enters directly to the nozzle (1) at the same pressure which it was released from the accumulator, i.e., between 4.82 and 6.89 bar. From the FIGS. 3 and 7, it is possible to observe that the entry to the nozzle (1) occurs ahead the access (5) of enriched air to normal pressure, 20 psi (1.38 bar), and adjacent to the casing (6) of reactor for producing the reaction in the melting bath, inside the reactor.

When the air impact is injected from the accumulator (2), two effects or physical phenomena occur: the Venturi effect and the Coanda effect. The first sets that the air impact pulls the enriched air to normal pressure, i.e., produces suction of the enriched air, helping it flow towards the inside of reactor. The second effect causes the flow of the high pressure air impact to remain in the direction of the flow and close to the lower part of the wall of nozzle (1) tube. This effect produces breaking of the obstructive accretion (7) deposited in the lower part of the nozzle, at the entrance of reactor. Accordingly, these principles inhibit the production of an obstructive accretion, allowing a continuous flow of enriched air towards the inside of the melting bath.

On the other hand, the connection angle ($\alpha$) between the tube (4) and the nozzle (1) ranges from 140° to 160°, preferentially 1500. This angle ($\alpha$) allows the air to run effectively through the nozzle (1) and not hit on the wall of it.

The piston valve (3) is commanded by a solenoid 12 (FIG. 4) which is commanded by a timer or programmable PLC 13 (FIG. 4) in order to define the times and sequences of air impact injections. This means, in fact, that use in a nozzle line placed in a converter, as it is shown in the FIG. 8, can define sequentially a frequency of air impact injections for influencing the surge into the melting bath, which will improve the melting kinetics.

Alternatively, the system can have a flow measure device in the nozzle (1) in order to perform the air impact when the order from an actuator is received, e.g., a PCL, depending from the measure device, for releasing its contents when the normal air flow which should circulate for the nozzle decreases respect to a pre-established value. The measure device should be preferentially an optical sensor 15 (FIG. 1) which can be able to observe if the nozzle (1) is blocked, if an obstruction is observed, this sensor emits a signal towards an actuator, e.g. the PLC, which drive the valve (3) allowing the injection of the air impact which will remove all the accretions that are obstructing the nozzle (1).

When the air impact is performed through the nozzle, the effect of the rate is extremely relevant because such a rate, associated with the pressure of the air, will define the penetration length of the air in the inside wall of the converter, from the inside end (8) of nozzle (1) to the melting bath. However, this will depend on the density of gas respect to the melting liquid and, in turn, to the Froude number, which is the travel that the gas makes into the liquid forming the melting bath.

According to an empirical relation for converters, developed by Hoefele and Brimacombe in 1994, the penetration of a gas in a liquid is given by the following equation:

$$x_c = 10.7\,Fr^{0.92}\left(\frac{\rho_g}{\rho_l}\right)^{0.35} d_t, \text{ where:}$$

$\rho_g$: gas density $\rho_l$: liquid density $d_t$: nozzle diameter

In turn, the Froude number, Fr, is defined as follows:

$$Fr = \frac{V_g}{\sqrt{g\left(\frac{\rho_l}{\rho_g} - 1\right)d_t}},$$

, where $V_g$: gas rate at the exit of nozzle.

This means that the air impact which enters into the melting bath will produce a cooling of the melting bath in the extent of its penetration, beginning the formation of the directed accretion (9), as shown in the FIG. 2, from the bath material which it is solidified due to the before mentioned cooling. This effect produces a natural lengthening of the tube which is part of the nozzle (1), from the inner wall of rector.

The natural lengthening of the tube which is part of the nozzle (1), produced by the directed accretion (9), results in the enriched air which is blown by the nozzle (1) entering deeper into the melting bath, traveling a distance that ranges between 11 and 22 cm, approximately. Because of this distance of penetration, the enriched air penetrates to a longer distance from the reactor or converter wall and, consequently, to a longer distance from the refractory material, in a zone where the bath surge already exists, preventing the occurrence of obstructive accretions (7) since the very surge will tend to eliminate them. Therefore, a combination between the surge and the high pressure and rate air impact is produced.

As was already shown, the rate associated to the pressure has a basic role in the formation of the directed accretion. This rate ranges from 263 to 328 m/s at the exit of the piston valve (3) when the air impact is produced, and arrives to the nozzle (1) with a rate which ranges from 195 to 300 m/s.

The examples presented below show the results obtained with the application of the air impact and its incidence in the distance of penetration into the bath.

Calculation of the Froude number for the different operation states:

The calculation of Froude number is performed from the density ratios

| Ratio $\frac{\rho_g}{\rho_l}$ | 0.000233 | 0.000257 |
|---|---|---|
| $\frac{\rho_g}{\rho_l}$ = | 4291.85 | 3891.05 |

Diameter of entrance $d_e$=0.116 m Diameter in the linking pipe from Tube (4) to Nozzle (1) Inner diameter Nozzle d, =0.059 m. Inner diameter of nozzle.

Calculation of the exit rate in normal regime to 20 psi (1.38 bar):

With the following parameters of a CPS converter:

| | | | |
|---|---|---|---|
| Q = | 750 | Nm3/min | |
| Q = | 0.227 | Nm3/s | Volume of oxigen-enriched air |
| Vc = | 21.51 | m/s | Rate in the feeding pipe |
| $V_g$ = | 83.129 | m/s | Rate in the nozzle exit |

Calculation of the Froude number for the normal state:

| Ratio $\frac{\rho_g}{\rho_l}$ | 0.000233 | 0.000257 |
|---|---|---|
| $Fr = 1.67$ | 1.75 | Froude number for the normal state. |
| $x_c/d_t = 0.92$ | 0.99 | Empirical ratio for the air penetration into the liquid |

Therefore, the travel of the air in the bath is:

$x_c$=54.1 58.6 mm Travel of the air in the bath, in mm.

Calculation of the exit rate with the air impact system using a pressure of 80 psi (5.52 bar)

Rate in the system c=263,137 m/s Rate in the exit of the air impact system Rate in the nozzle tube $V_g$=195,076 m/s Rate in the exit of the nozzle tube Calculation of the Froude number for the state with the air impact system:

| Ratio $\frac{\rho_g}{\rho_l}$ | 0.000233 | 0.000257 |
|---|---|---|
| $Fr = 3.91$ | 4.11 | Calculation of the Froude number for the state with the air impact system |

Therefore, the values of the empirical ratio for the air penetration are $x_c/d_t$=2.01 2.18 Empirical ratio for the air penetration into the liquid Therefore, the travel of the air in the bath is equal to:

$x_c$=118.6 128.4 Travel of the air in the bath, in mm.

Calculation of the exit rate with the air tube using a pressure of 100 psi (6.89 bar)

Rate in the system c=328,921 m/s Rate in the exit of the air impact system Rate in the nozzle tube $V_g$=243,846 m/s Rate in the exit of the nozzle tube Calculation of the Froude number for the state with the air impact system:

| Ratio $\frac{\rho_g}{\rho_l}$ | 0.000233 | 0.000257 |
|---|---|---|
| $Fr = 6.60$ | 6.93 | Froude number for the state with air impact system |

Therefore, the values of the empirical ratio for the air penetration are:

$x_c/d_t$=3.25 3.52 Empirical ratio for the air penetration into the liquid

Therefore, the travel of the air in the bath is equal to:

$x_c$=191.8 207.6 Travel of the air in the bath, in mm.

The invention claimed is:

1. A system for keeping blow nozzles free of accreted obstruction wherein the flow nozzles extend through casings of reactors or fusion converters used in processing mined materials or used in practicing in pyrometallurgy, the system comprising:

at least one blow nozzle having a central axis, an outlet end adjacent to an inner wall of a casing for a metallurgical processing vessel and opening beneath the surface of a melting bath in the vessel, the blow nozzle having an enriched air inlet for connection to a source of enriched air that flows under a pressure at least as high as atmospheric pressure into the melting bath, the inlet for the source of enriched air being above the nozzle;

a tube fluidly connected to the nozzle outlet upstream of the outlet end of the nozzle and downstream of the enriched air inlet of the nozzle, the tube being below the nozzle;

an air accumulator that stores compressed air at a pressure substantially above the pressure of the enriched air;

a valve between the accumulator and the tube, the valve being a rapidly opening valve that introduces compressed air impulses into the nozzle of a duration and pressure sufficient to avoid formation of obstructing accretions at the outlet end of the nozzle, which accretions interfere with air flow through the nozzle, and a directed accretion created by the compressed air impulses, the directed accretion being in the form of a tubular extension of the nozzle outlet and extending axially out into the melt bath.

2. The system according to claim 1, wherein the accumulator has a capacity of 40-60 liters of compressed air.

3. The system according to claim 2, wherein compressed air is stored in the accumulator at a pressure of 70 to 100 psi (4.82 and 6.89 bar).

4. The system according to claim 3, wherein a given storage volume in the accumulator has a pressure according to the following table:

| Pressure in psi | Volume in liters |
|---|---|
| 70 | 42 |
| 75 | 45 |
| 80 | 48 |
| 85 | 51 |
| 90 | 54 |
| 95 | 57 |
| 100 | 60. |

5. The system according to claim 1, comprising a plurality of nozzles placed on the reactor or converter, each capable of defining a sequence of injection of air impacts influencing a surge in the a melting bath.

6. The system according to claim 1, wherein compressed air can be ejected from the accumulator at 263 to 328 m/s.

7. The system according to claim 1, in which compressed air reaches the nozzle at 195 to 300 m/s.

8. The system according to claim 1, having a flow measuring device in the nozzle monitoring the compressed air impulse an order to actuate the valve when normal air flow for a nozzle decreases with respect to a pre-established value.

9. The system according to claim 8, wherein the measuring device is an optical sensor which is able to observe if the nozzle is blocked.

10. The system of claim 1, wherein the tube is oriented at an angle in a range of 140° to 160° with respect to the axis of the nozzle.

11. The system of claim 1, wherein the angle is 150°.

12. The system of claim 1, further including a solenoid for operating the valve and a timer or programmable PLC connected to the solenoid for defining the times and sequences of injection of compressed air impulses.

13. The system of claim 12, wherein each compressed air impulse has a duration of 0.09 seconds.

* * * * *